United States Patent [19]

Yoshida et al.

[11] 4,052,276

[45] Oct. 4, 1977

[54] TREATMENT PROCESS FOR ELECTROLYTIC PURIFYING OF USED SOLUTION FOR ELECTROLYTIC TIN PLATING

[75] Inventors: Minoru Yoshida; Susumu Yamaguchi; Yoshihiko Hirano, all of Himeji, Japan

[73] Assignee: Nippon Steel Corporation, Tokyo, Japan

[21] Appl. No.: 676,668

[22] Filed: Apr. 14, 1976

[51] Int. Cl.[2] ..... C25D 5/50; C25C 1/14

[52] U.S. Cl. ..... 204/130; 204/37 T; 204/120

[58] Field of Search ..... 204/120, 121, 122, 130, 204/149, 37 T

[56] References Cited

U.S. PATENT DOCUMENTS

| | | | |
|---|---|---|---|
| 1,918,477 | 7/1933 | Lang et al. | 204/130 |
| 2,313,371 | 3/1943 | Stack et al. | 204/120 |

*Primary Examiner*—R. L. Andrews

*Attorney, Agent, or Firm*—Toren, McGeady and Stanger

[57] ABSTRACT

A process for regenerating an aqueous solution of organic electrolyte used for immersion or spraying treatment of tin plated materials prior to the melting treatment in the electrolytic tin plating, in which tin is removed from the solution and the regenerated solution is circulated and supplied for further use.

11 Claims, 6 Drawing Figures

TREATMENT PROCESS FOR ELECTROLYTIC PURIFYING OF USED SOLUTION FOR ELECTROLYTIC TIN PLATING

BACKGROUND OF THE INVENTION

1. Field of the Invention

The present invention intends to reduce the expense necessary in the treatment of used solution and to recover useful materials, such as, tin by circulatingly employing the used solution of organic electrolyte.

2. Description of the Prior Art

In the manufacture of a tin-plated steel strip, the tin-plated material is usually immersed in an organic electrolyte solution or, alternatively, the same solution is sprayed to the material for surface conditioning before the tin-melting step. In either the immersion or the spraying treatment of electrolytic tin plated materials, tin accumulates in the organic electrolyte solution by being dissolved from the material or by transferring from the preceding treating solution. The accumulated tin may be likely to reduce the efficacy of the organic electrolyte solution and, as a result, a lustrous surface will not result in the final melting treatment.

The same applys when the organic electrolyte solution is sprayed onto an electrolytic tin plated material and the excess of the solution is collected for repeated use. When the efficacy of an organic electrolyte solution is lost because of accumulated tin, this must be replaced by a fresh solution of the same organic electrolyte. However, since the exhausted solution is still strongly acid and has high COD values, it can not be discarded as it is. A necessary remedy is, for example, to neutralize the solution with lime to precipitate the tin in the form of the hydroxide and chemically oxidizing the filtrate. Also, an oxidative decomposition treatment may be applied to the solution by a biochemical means before being discarded in a non-polluting form. However, such treatments necessarily require large capital expenditures for the plant and high consumption of chemicals, and also an increased floor space for the plant. Even so, useful materials, such as, tin and the organic electrolyte are lost.

On the other hand, attempts have been made to regenerate an organic electrolyte solutions having a high concentration of tin. One of the methods involves concentration of the solution in a vacuum evaporator followed by transfer to the plating bath. This method requires a large amount of heat energy for evaporation. In addition, some of the solutions must be discarded owing to the unbalanced ratio in the amounts of tin and the organic electrolyte.

Another category of the methods is concerned with recovering tin by electrolysis. Since this method is intended to recover concentrations of tin lower than 0.1 g/l by electrolysis, emphasis is laid on how to improve the current efficiency in the electrolysis of a low concentration solution, and methods and apparatuses have been developed. However, these still involve high treatment costs.

SUMMARY OF THE INVENTION

The present invention has been developed to overcome the above mentioned difficulties, and relates to a circulative treatment process of a used tin plating solution, in which tin in the used solution of an organic electrolyte is removed prior to the melting treatment in the electrolytic tin plating process and the resulting solution is further circulated for treating the tin-plated materials comprising extracting tin in the used solution by electrolysis to maintain the concentration of tin in the range from 0.2 to 5.0 g/l.

According to the present invention, the used organic electrolyte solution from which tin has been recovered by electrolysis is circulatingly supplied to effectively treat tin-plated steel strip and the tin recovered can be used for the proper purpose without substantial loss of the natural resource. The apparatus necessarily required for the circulative treatment of this invention basically include those of compulsory circulation of the fluid and electrolysis, which cost much less than the prior art apparatuses for the regeneration and treatment to overcome the pollution problem.

DETAILED EXPLANATION OF INVENTION

The present invention will be described in more detail referring to the attached drawings in which.

Figure 3A:
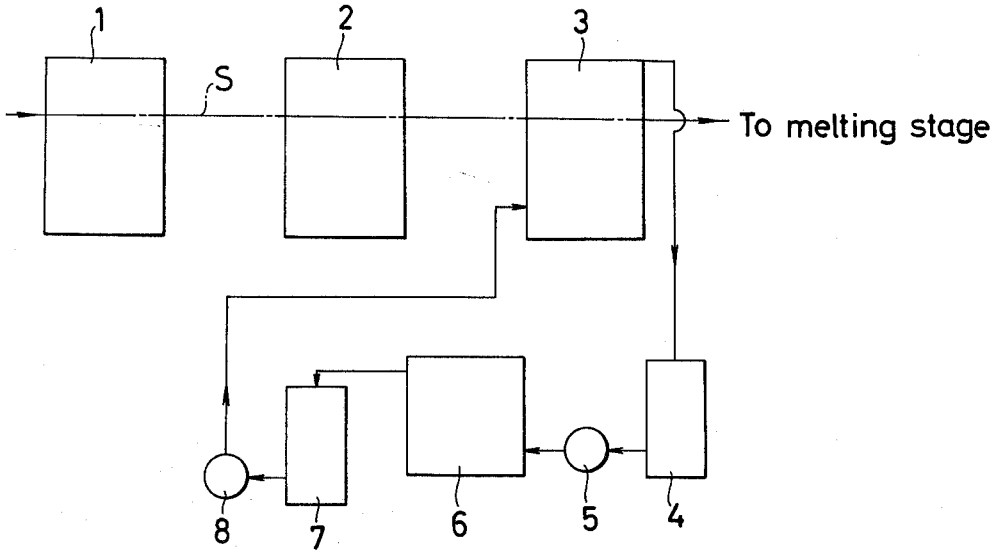

In FIG. 3(A) the schematic flow of the present invention is shown.

Figure 3B:
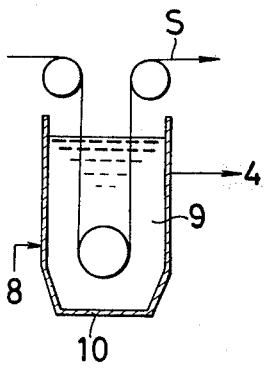
Figure 4:
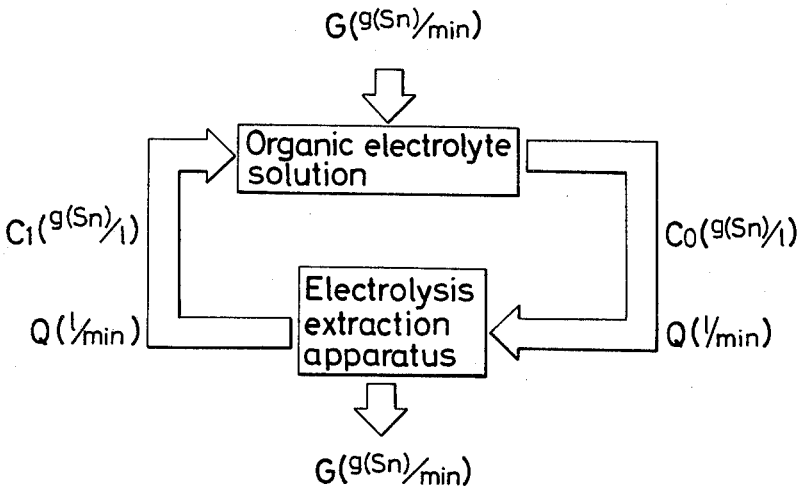

FIGS. 3(B) and (C) are to explain how the treatment goes with the organic electrolyte solution and FIG. 4 is provided to show material balance in this invention.

In an electrolytic tin plating process, materials plated with tin are usually immersed in an aqueous organic electrolyte solution or the same solution is sprayed to the materials prior to the melting treatment to obtain sound plated surface.

The aqueous organic electrolyte solutions include 0.015 to 0.12 mol/l aqueous solution of aromatic sulfonic acids, such as, benzenesulfonic acid, xylenesulfonic acid, toluenesulfonic acid, phenolsulfonic acid, cresolsulfonic acid, naphthalenesulfonic acid. Aliphatic carboxylic acids are also employed.

Used aqueous organic electrolyte solutions were found to contain only tin other than the above mentioned aromatic sulfonic acids. This fact implys that regeneration of these solutions is possible by mere removal of the tin.

Figure 1:
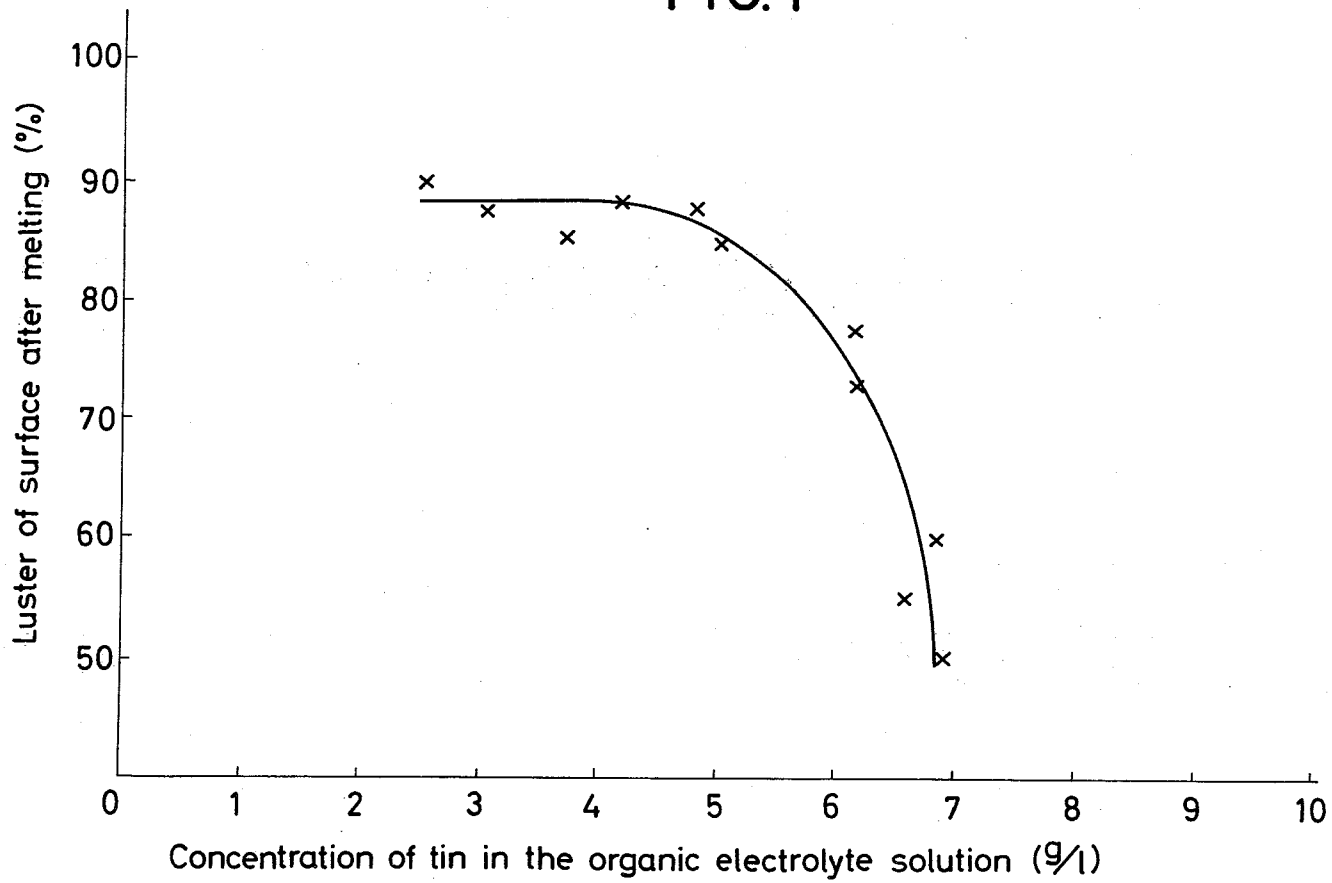
FIG. 1 is a diagram showing the luster of the tin surface after the tin melting treatment as a function of the concentration of tin in the organic electrolyte solution.

In the next place, the luster of the tin-plated surface was examined after the tin melting treatment as a function of the concentration of tin in the organic electrolyte solution. Results are that the solutions demonstrate satisfactory activity to make lustrous surfaces even if the metal ion concentration is not diminished to several mg/l which is a value required in the non-pollution treatment of metal ion solutions. Results are shown in FIG. 1. As is seen in the figure, satisfactorily high luster of surfaces can be produced when the concentration of tin does not exceed 5 g/l in the organic electrolyte solutions. The experiment was carried out according to "measurement of luster" JIS Z8741.

Figure 2:
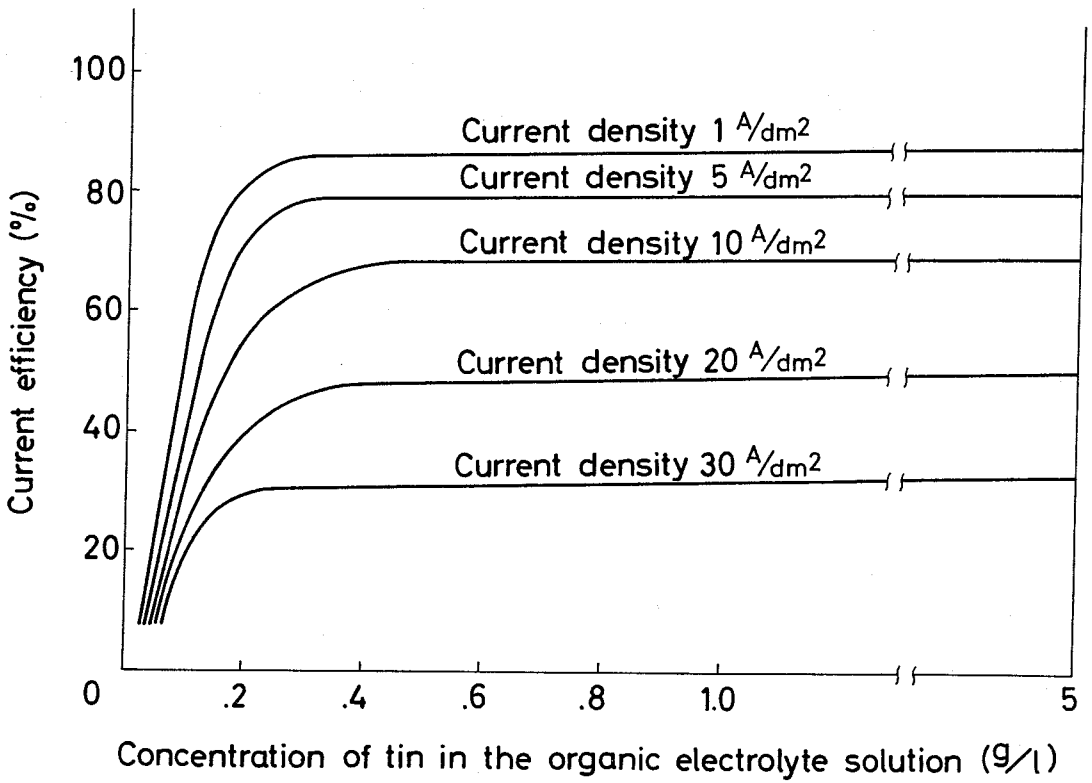
FIG. 2 is a diagram showing the relationship between the concentration of tin in the organic electrolyte solution and the current efficiency in the electrolytic extraction of tin.

As mentioned above, it suffices for the present purpose that the concentration of tin is reduced below 5 g/l in the organic electrolyte solution. Therefore, the present process provides an economical method, that is electrolysis, for removing tin, though the current efficiency would be lower for lower concentrations of tin. FIG. 2 demonstrates how the current efficiency varies with the concentration of tin in the organic electrolyte solutions.

In most electrolytic deposition treatments, current efficiency of at least over 40% is needed, thus requiring the concentration of tin to be over 0.2 g/l. The efficiency is also influenced by the current density. The upper limit of the current density recommended lies between 20 and 25 A/dm², while the lower limit is about 5 A/dm² because the lower current density requires a larger area of the electrode without providing any advantages.

In the present invention, the upper limit of the concentration of tin in the organic electrolyte solutions is determined by considering the luster of surfaces after the molten tin treatment and the lower limit is controlled from the viewpoint of the current efficiency in the electrolytic removal of tin.

During the process of electrolytic tin plating, the amount of tin accumulated in the organic electrolyte solutions increase at a constant rate. Consequently operations to remove tin may be carried out in a certain frequency that should correspond to the rate of increase of tin in the solutions.

FIG. 3(A) is the flow scheme of this invention; in the plating stage 1 a strip S is electrolytically plated with tin, and washed with water in the first washing stage 2, and then led to the stage 3 for treatment with an organic electrolyte solution. The electrolytically tin-plated strip thus formed is transferred to the tin melting stage.

The stage of treatment with an organic electrolyte solution will be explained in detail referring to FIGS. 3(B) and 3(C). FIG. 3(B) shows the immersion process where a strip S is immersed in an organic electrolyte solution 10 contained in a tank.

Figure 3C:
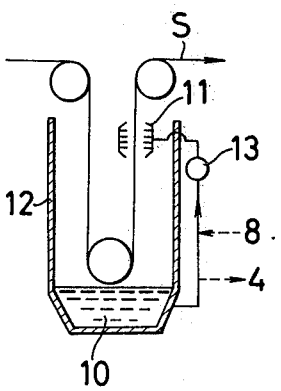

On the other hand, FIG. 3(C) shows the spraying process in which an organic electrolyte solution is sprayed to a strip S by means of a spray 11 and the excess of the solution 10 is kept in a tank 12 for circulative use with a pump 13.

In the mentioned electrolytic tin plating line, accumulation of tin in the organic electrolyte solution comes both from dissolution of the tin layer on the surface of the electrolytically tin-plated strip and from transferring from the first washing stage 2. The amount of accummulated tin differs depending on the scale and structure of the line, but amounts to as much as several kg/day to more than 10 kg/day.

The organic electrolyte solution in which tin is accummulated is taken out to the tank 4, as shown in FIG. 3(A), and transferred to the electrolytic extraction tank 6, where the concentration of tin is reduced by electrolysis, and then returned to the organic electrolyte solution tank 3 via tank 7 and pump 8, to maintain the final concentration of tin at 0.2 to 0.5 g/l. The tank 4 and the pump 7 may be omitted. The electrolysis apparatus employed here is not particularly specified, but many ordinary types of electrolysis cell could be used for the present purpose. For example, titanium metal plated with platinum or rhodium and insoluble graphite may be used as the anode, while stainless steel, lead, copper and graphite may serve as cathode. The anode may generally be in the form of net, punched plate, lattice and plain plate and the form of the cathode may be determined as appropriate to the way of extraction.

Thus, what is necessary with the electrolytic extraction apparatus of this invention is not the extent to which the concentration of tin ion can be reduced, but the amount of tin that can be deposited by electrolysis per hour. Quantative treatment of this process goes as follows with FIG. 4 as a reference. The flow rate Q with which the used organic electrolyte solution is transferred to the electrolytic extraction apparatus 6 with pump 5 should satisfy the following expression:

$$Q = (G)/(C_O - C_1)$$

where $C_O$ and $C_1$ are the concentration in g/l of tin in the organic electrolyte solution entering and leaving, respectively, the electrolytic extraction apparatus, and necessarily $C_O$ is greater than $C_1$, both being in the range 0.2 to 5.0 g/l. Q is the flow rate in l/min. of the liquid entering and leaving the electrolytic extraction apparatus. G, as seen in FIG. 4, is the increasing rate of tin in g/min. in the organic electrolyte solution tank, and therefore the extraction rate of tin in g/min. In the electrolytic extraction apparatus must also be close to G.

In practicing the present invention, it is desirable to make compulsory flow of liquid to supply tin ions onto the cathode in the electrolytic extraction apparatus. Although the circulating flow of liquid produced by the pump is useful, another device to agitate the solution around the cathode is more desirable. The electrolytic extraction may be carried out either continuously or intermittently.

Examples of the present invention will be described.

EXAMPLE 1

In a pilot line for making tin plating, an organic electrolyte solution containing 8 g/l of cresolsulfonic acid was used. The process to make tin plating on strips was followed under the condition that the tin dissolved in and transferred to the organic electrolyte solution amounted to 0.85 kg/day. When the concentration of tin in the solution reached 1.2 g/l, the tin was extracted by electrolysis, and the resulting solution was circulated for repeated use.

The electrolysis was conducted under the conditions described below.

Apparatus: Electrolysis apparatus with a small-size belt electrode
Cathode area: 4 dm²
Current density: 5 A/dm²
Applied voltage: 7 V
Cathode material: Steel strip SUS27
Anode material: Platinum-plated titanium
Electrode distance: 4 cm Under these conditions the current efficiency was as high as 82%, and the concentration of tin in the organic electrolyte solution, as determined at certain time intervals throughout 5 hour experiment was kept in the range 1.2 to 0.9 g/l, which is an appropriate concentration range to producing lustrous surfaces after tin-melting treatment.

In contrast when the tin in the organic electrolyte solution was not extracted by electrolysis, the concentration of tin reached up to over 5 g/l, more than the limit to secure the lustrous surface, in 90 hours of experiment.

EXAMPLE 2

In a tin-plating line of the ferrostan type, tin-plating of strips was conducted using an organic electrolyte solution containing 10 g/l phenolsulfonic acid under the condition that the tin dissolved in and transferred to the organic electrolyte solution amounted to about 5.5 kg/day. When the concentration of tin in the solution reached 2.2 g/l, the tin was extracted by electrolysis under the following conditions, and the resulting solution was circulated for repeated use.

Apparatus: Electrolysis apparatus with a rotary electrode
Cathode area: 16 $dm^2$
Current density: 10 $A/dm^2$
Applied voltage: 15 V
Cathode and anode material: The same as in Example 1
Electrode distance: The same as in Example 1
Linear flow rate parallel to the cathode surface: 4 cm/sec.

With these conditions maintained, the current efficiency as high as 65% was obtained and the concentration of tin in the organic electrolyte solution, as determined at certain time intervals throughout about 50 hours of tin plating process, was kept in the range 2.1 to 2.5 g/l. The surface luster produced by the tin melting treatment was beautiful enough to give 88% luster, as measured according to JIS Z8741.

In contrast, when the tin in the organic electrolyte solution was not extracted by electrolysis, the concentration of tin usually became more than 5 g/l in 50 hours of operation, as experienced in foregone runs.

In the process of electrolytic tin plating line of this invention, the advantages are that aromatic sulfonic acids can be repeatedly used as electrolyte material and tin can be recovered by electrolysis with a high current efficiency. The process of the present invention is economical and consumes the useful natural resource to a lesser extent.

What is claimed is:

1. In an electrolytic tin plating process wherein a material is subjected to a tin melting treatment and prior to the melting treatment, the material is contacted with a solution of an organic electrolyte, the improvement which comprises the organic electrolyte, after being used to contact the material being subjected to an electrolytic treatment to deposit the tin therefrom so as to maintain the tin concentration therein in the range from 0.2 to 5.0 g/l and the electrolytically treated solution being returned to the material contact step.

2. The process of claim 1 wherein the contact step is carried out by immersing the material in the solution.

3. The process of claim 1 wherein the contact is carried out by spraying the material with the solution.

4. The process according to claim 1, wherein the organic electrolyte solution is an aqueous solution of 0.015 to 0.12 mol/l benzenesulfonic acid.

5. The process according to claim 1, wherein the organic electrolyte solution is an aqueous solution of 0.015 to 0.12 mol/l xylenesulfonic acid.

6. The process according to claim 1, wherein an organic electrolyte solution is an aqueous solution of 0.015 to 0.12 mol/l toluenesulfonic acid.

7. The process according to claim 1, wherein the organic electrolyte solution is an aqueous solution of 0.015 to 0.12 mol/l phenolsulfonic acid.

8. The process according to claim 1, wherein the organic electrolyte solution is an aqueous solution of 0.015 to 0.12 mol/l cresolsulfonic acid.

9. The process according to claim 1, wherein the organic electrolyte solution is an aqueous solution of 0.015 to 0.12 mol/l naphthalenesulfonic acid.

10. The process according to claim 1, wherein the organic electrolyte solution is an aqueous solution of 0.015 to 0.12 mol/l succinic acid.

11. The process according to claim 1, wherein the current density in the electrolytic treatment is between 5 to 25 $A/dm^2$.

* * * * *